US006725472B2

(12) United States Patent
Gray et al.

(10) Patent No.: US 6,725,472 B2
(45) Date of Patent: Apr. 27, 2004

(54) COMBINED FAUCET AND DRAIN ASSEMBLY

(75) Inventors: Ricardo O. Gray, Sheboygan, WI (US); Jeffrey L. Mueller, Plymouth, WI (US); Perry D. Erickson, Sheboygan, WI (US); Mark F. McMullen, Adell, WI (US)

(73) Assignee: Kohler Co., Kohler, WI (US)

( * ) Notice: Subject to any disclaimer, the term of this patent is extended or adjusted under 35 U.S.C. 154(b) by 115 days.

(21) Appl. No.: 10/289,484

(22) Filed: Nov. 6, 2002

(65) Prior Publication Data

US 2003/0070223 A1 Apr. 17, 2003

Related U.S. Application Data

(60) Division of application No. 10/072,092, filed on Feb. 8, 2002, now Pat. No. 6,484,330, which is a continuation-in-part of application No. 09/778,410, filed on Feb. 7, 2001, now Pat. No. 6,367,102.

(51) Int. Cl.[7] ..... E03C 1/232; E03C 1/04

(52) U.S. Cl. ..... 4/684; 4/675; 4/678; 137/801; 137/606

(58) Field of Search ..... 4/684, 678, 675, 4/676, 677, 695, 696; 137/801, 606; 411/410, 404, 919

(56) References Cited

U.S. PATENT DOCUMENTS

| | | | | |
|---|---|---|---|---|
| 1,848,521 A | | 3/1932 | Fleck | |
| 1,910,182 A | * | 5/1933 | Robertson | 411/410 |
| 2,082,748 A | | 6/1936 | Brown | |
| 2,063,399 A | | 12/1936 | Rasmussen | |
| 2,173,707 A | * | 9/1939 | Brown | 411/919 |
| 2,282,212 A | | 5/1942 | Pope | |
| 2,400,684 A | * | 5/1946 | Clark | 411/919 |
| 2,479,485 A | | 8/1949 | Frank | |
| 2,556,155 A | * | 6/1951 | Stellin | 411/410 |
| 3,125,764 A | | 3/1964 | Young | |
| 3,287,742 A | | 11/1966 | Gaddis | |
| 3,333,815 A | | 8/1967 | Downey et al. | |
| 3,353,192 A | | 11/1967 | Christiansen | |
| 4,006,498 A | | 2/1977 | Cuschera | |
| 4,281,857 A | | 8/1981 | Randall | |
| 4,557,288 A | | 12/1985 | Botnick | |

(List continued on next page.)

FOREIGN PATENT DOCUMENTS

| | | |
|---|---|---|
| DE | 3330156 C1 | 12/1984 |
| DE | 3502953 A1 | 10/1985 |
| EP | 0231557 A1 | 8/1987 |
| EP | 0333202 A1 | 9/1989 |
| JP | 2-20731 | 1/1990 |

OTHER PUBLICATIONS

A 2000 advertisement by Sterling entitled "Durable–Depenable . . . ".

A Kohler Co installation Instrction sheet, undated, admitted prior art.

*Primary Examiner*—Gregory Huson
*Assistant Examiner*—Khoa Huynh
(74) *Attorney, Agent, or Firm*—Quarles & Brady LLP

(57) ABSTRACT

A combined faucet and drain system can be installed primarily from above the basin. The faucet includes a quick-connect fastening assembly with a threaded sleeve bolt that also doubles as a life rod guide. A spring-biased toggle fastener threads onto the sleeve bolt and collapses when inserted through an installation opening from above the basin. It then automatically unfolds and engages an undersurface when the sleeve bolt is turned. The drain assembly is mounted in a drain opening of the basin and includes a movable stopper guide that can be used during installation to align the drain flange to the drain body from above the sink. A method of installing a combined faucet and drain assembly to a plumbing fixture is also disclosed.

4 Claims, 7 Drawing Sheets

U.S. PATENT DOCUMENTS 4,927,287 A 5/1990 Ohkawa et al.
5,027,851 A 7/1991 Drees et al.
5,050,246 A * 9/1991 Huntoon ..... 4/695
5,819,328 A 10/1998 Lewis
5,946,746 A * 9/1999 Bloom ..... 4/675
6,085,784 A 7/2000 Bloom et al.
6,138,290 A 10/2000 Lin
6,138,296 A * 10/2000 Baker ..... 4/678
6,293,745 B1 * 9/2001 Lu ..... 411/410
6,302,632 B1 10/2001 Lin
6,328,059 B1 * 12/2001 Testori et al. ..... 137/315.12
6,360,770 B1 * 3/2002 Buchner et al. ..... 4/678
6,370,712 B1 * 4/2002 Burns et al. ..... 4/675
6,381,776 B1 * 5/2002 Wang ..... 4/695

* cited by examiner

FIG. 8
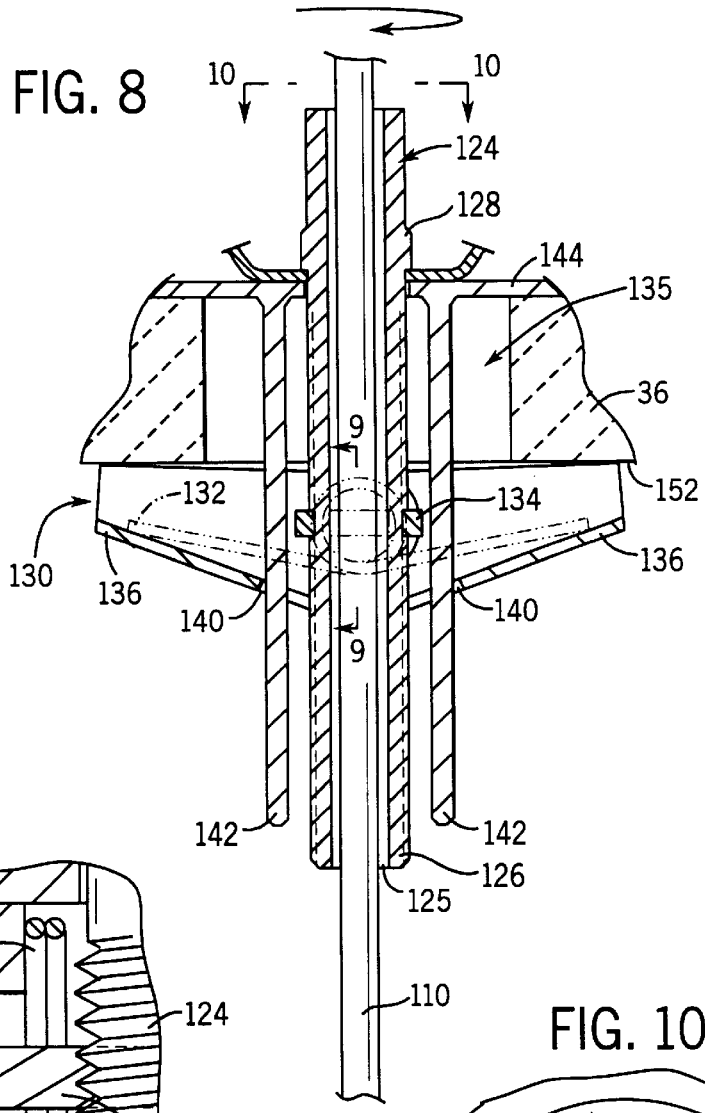
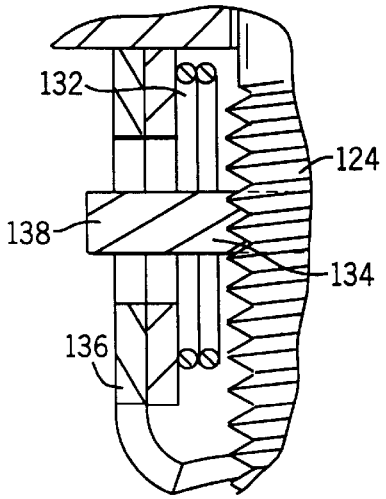
FIG. 9
FIG. 10
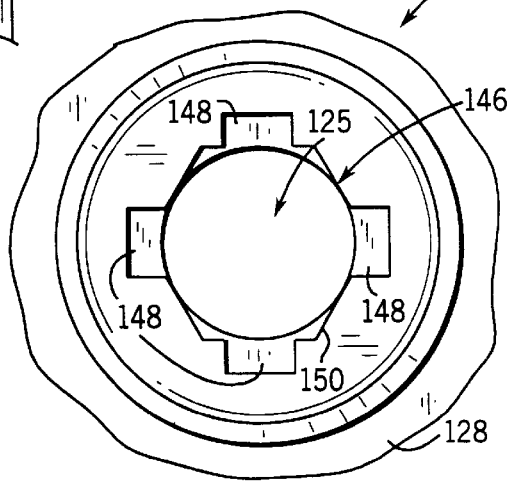

COMBINED FAUCET AND DRAIN ASSEMBLY

CROSS-REFERENCE TO RELATED APPLICATIONS

This application is a divisional of U.S. application Ser. No. 10/072,092, filed Feb. 8, 2002, now U.S. Pat. No. 6,484,330 issue fee paid, which is a continuation-in-part of U.S. application Ser. No. 09/778,410, filed Feb. 7, 2001, now U.S. Pat. No. 6,367,102, issued Apr. 9, 2002.

STATEMENT REGARDING FEDERALLY SPONSORED RESEARCH/DEVELOPMENT

Not applicable.

BACKGROUND OF THE INVENTION

The present invention relates to plumbing fixtures. More particularly it relates to combined faucet and drain control assemblies that can, to a large extent, be mounted on a counter top, sink or the like from above the wash basin.

Conventional faucets and drain assemblies often require the installer to connect most of the components of the assembly from beneath the sink in typically cramped, dark spaces. While professional plumbers may be used to working in this type of environment, many such plumbing fittings are now being designed for installation by consumers who have little experience in, and less tolerance for, working in such an environment for a prolonged period. Thus, faucets and drain assemblies that can, to a greater extent, be assembled from above the basin are desirable.

For example, the drain assembly disclosed in U.S. Pat. No. 3,287,742 used a separate threaded fastener aligned axially at the center of the drain opening and connected at its ends to cross members of the drain flange and the waste housing positioned beneath the basin. The fastener could be assembled and tightened from above the basin. This assembly, however, did not provide for use with a movable drain stop operated by a lever mechanism.

U.S. Pat. No. 4,557,288 disclosed a faucet fixture that could be mounted from above the basin using a toggle bolt. The arms of the toggle bolt were limited in rotation by contacting with nearby water supply conduit, which allowed the toggle to travel upward and clamp against an underside of the basin (or the deck to which the basin is mounted). Drawbacks of this assembly were that separate toggle fasteners were required (thus adding parts) and that the water conduit needed to be placed next to the fastening location (thus limiting design flexibility).

There have been other attempts as well to clamp a faucet to a counter top or the like by using rotation of a faucet assembly feature above the counter top to drive up a clamping mechanism located below the counter top. See e.g. U.S. Pat. Nos. 5,465,749 and 6,085,784. However, these designs had deficiencies. It was particularly desirable to reduce the number of holes needed in the faucet to achieve this clamping function, to simplify the assembly, and to improve the reliability and ease of manufacture of the clamping mechanism.

Thus, a need still exists to provide an improved assembly for installing a faucet and its associated drain primarily from above the basin.

BRIEF SUMMARY OF THE INVENTION

In one aspect the invention provides a faucet mountable through a hole in a mounting wall. The faucet has a faucet body having an upper opening, and a fastener assembly for connecting the faucet body to the mounting wall.

The fastener assembly in turn has a sleeve bolt mounted on the faucet body so as to be able to rotate on a longitudinal axis of the bolt, the bolt having a threaded outer section and an axial bore alignable with the upper opening of the faucet body. There is also a fastener having a nut that is threadable on the threaded outer section of the bolt so as to ride along it in response to rotation of the bolt, the fastener also having a wing structure that is pivotable from a collapsed configuration to an extended configuration. The fastener also has a guide passage between the nut and wing structure in which a guide fixed with respect to the faucet body is placed.

The guide opening limits rotation of the nut around the longitudinal axis of the bolt. A lift rod is positioned through the upper opening of the faucet body and extendable through the axial bore of the bolt.

In preferred forms an upper end of the sleeve bolt has a tool attachment recess suitable to receive all of a flat screwdriver, a Philips screwdriver and a hex-driver, one at a time. Further, there is a spring to bias the wing structure to the extended configuration, and there are two such guides positioned on opposite sides of the nut.

In another aspect the invention provides a combined faucet and drain assembly for installation with a plumbing fixture. One main part of the assembly is a faucet. It has a faucet body with an upper opening, and a fastener assembly for fixing the faucet body in position relative to the fixture. The fastener assembly includes a sleeve bolt mounted on the faucet body so as to be able to rotate on a longitudinal axis of the bolt. The bolt also has a threaded outer section and an axial bore alignable with the upper opening of the faucet body.

A fastener rides along the bolt in response to rotation of the bolt, the fastener also having a clamp structure that is movable from a collapsed configuration to an extended configuration. There is also a lift rod positionable through the upper opening of the faucet body and extendable through the axial bore of the bolt.

A second main portion of the assembly is a pop-up drain valve assembly. It has a drain body having a cross-member extending laterally at an axial opening and having a radial opening. There is also a drain flange having a cross-member extending laterally at an axial opening, a stopper guide having downwardly extending legs defining an axial slot there between for accommodating the drain body and flange cross members, a stopper connectable to an upper portion of the stopper guide and sized to seal against the drain flange, and a control stem connectable to the stopper guide at one end, extendable through the radial opening of the drain body, and connectable at the other end to a lower end of the lift rod.

In another aspect the invention provides a method of installing a faucet and a drain assembly on a fixture having an essentially horizontal support wall and a basin. One temporarily mounts, from beneath the support wall, a drain body to a drain opening in the basin, then inserts a drain flange into the drain opening from above the basin, rotationally aligns the drain flange to the drain body from above the basin, fastens the drain flange and the drain body to the basin, positions a stopper in the drain body from above the basin, links a drain valve stem to a lower end of the stopper, and inserts, from above the support wall, a faucet fastening assembly into an installation opening through the support wall so that a clamp portion of the fastening assembly is beneath the support wall and an adjustment sleeve bolt rotatably mounted to the clamp extends above the installation opening.

Rotating the sleeve bolt brings the clamp into a clamping position relative to the support wall. One then inserts a lift rod through the sleeve bolt from above the support wall, and connects the lift rod to the drain valve stem.

The present invention thus provides a system for mounting a faucet and drain assembly to a wash basin or the like quickly, easily and primarily from above the basin. The clamping assembly includes a collapsible toggle fastener that can be inserted down through an installation opening in the basin or nearby deck and then springs out so that it can be immediately tightened against an underside of the basin or deck by simply rotating the sleeve bolt. Removal of the clamp merely requires rotation of the bolt in the opposite direction until the toggle falls off.

Further, the unique stopper guide can be used during installation to align the drain flange and drain body and hold them in the proper alignment while being secured together. The stopper guide can then be removed so that a stopper can be quickly snapped or threaded onto its upper end and then dropped back into the drain opening for attachment to a valve stem which is in turn linked to the pull-up of the faucet.

The foregoing and still other advantages of the invention will appear from the following description. In that description reference is made to the accompanying drawings which form a part hereof and in which there is shown by way of illustration a preferred embodiment of the invention. That embodiment does not represent the full scope of the invention. Rather, the claims should be looked to in order to judge the full scope of the invention.

BRIEF DESCRIPTION OF THE DRAWINGS

FIG. 8 is a partial cross-sectional view similar to FIG. 7 showing the fastening assembly clamped against the basin;

FIG. 9 is a partial cross-sectional view taken along line 9—9 of FIG. 8 detailing the location of the toggle fastener spring;

FIG. 10 is top view of the fastening assembly taken from line 10—10 of FIG. 8 showing the upper end of a sleeve bolt having a more "universal" tool accepting recess.

DETAILED DESCRIPTION OF THE PREFERRED EMBODIMENT

Figure 1:
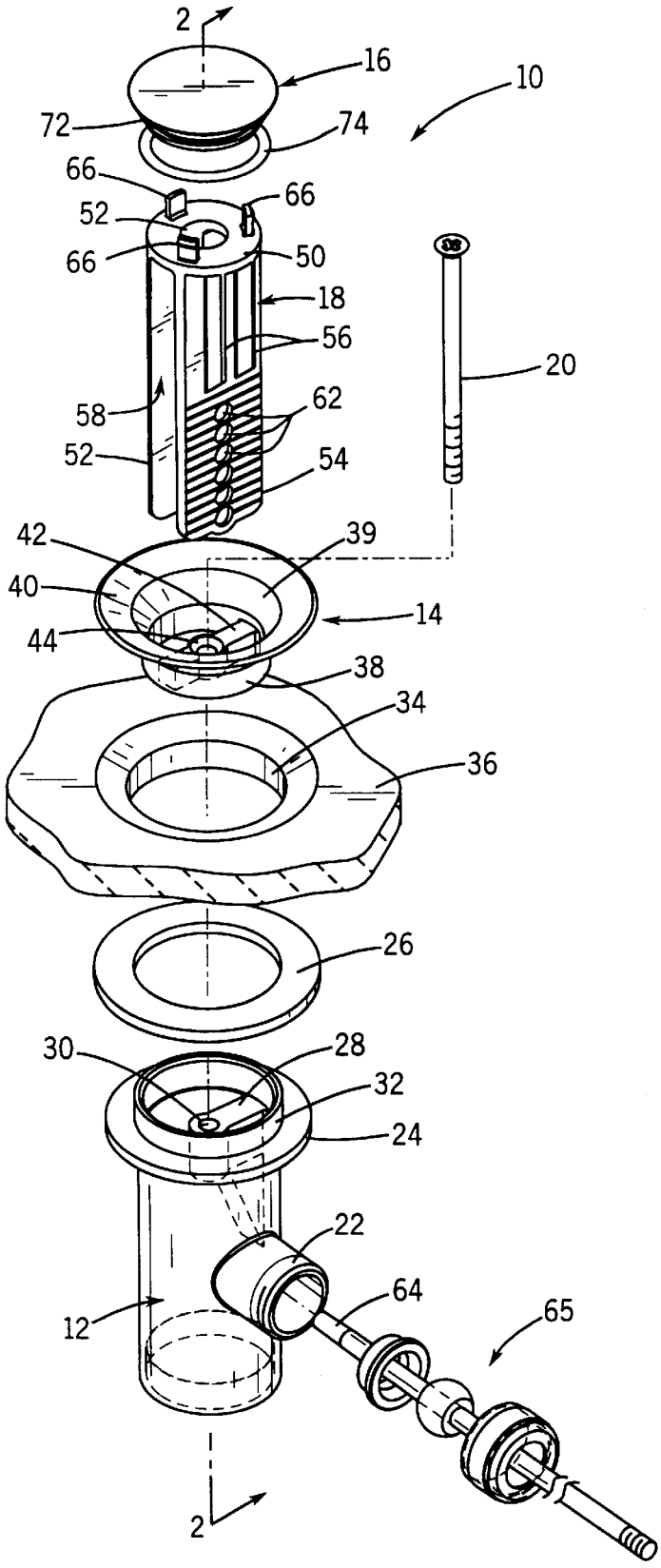
FIG. 1 is an exploded view of a drain assembly of the present invention.

Referring to FIG. 1, drain assembly 10 includes a main drain body 12, flange 14, a stopper 16, a stopper guide 18 and a threaded fastener 20. The drain body 12 is a tubular brass body having a radially extending nipple 22. An integral gasket support ring 24 extends around an upper end of the drain body 12 for supporting a rubber gasket 26. Also at the upper end of the drain body 12 is a cross-bar 28 extending laterally into the passageway of the drain body 12 having a threaded opening 30 at the axial centerline of the drain body 12.

An upper rim 32 of the drain body 12 is sized to fit inside of a conventional drain opening 34 of a sink or bathtub wash basin 36. Preferably, the rim 32 is fit into the drain opening 34 from beneath the basin 36 with the gasket 26 fit snugly around the drain body 12 and between the underside of the basin 36 and the gasket support ring 24. Friction will hold the drain body 12 in place temporarily until the rest of the assembly can be assembled from above the basin 36.

The drain flange 14 is preferably also brass and has a lower rim 38 sized to fit inside the upper rim 32 of the drain body 12 when it is inserted into the drain opening 34 from above the basin 36. The drain flange 14 has a frusto-conical surface 39 extending outwardly to a lip 40 with a diameter larger than the drain opening 34 to prevent it from falling through the drain opening 34. The drain flange 14 also has a crossbar 42 extending between the lower rim 38 and having an opening 44 at the axial centerline of the drain flange 14. As described below, the drain flange cross-bar 42 is preferably aligned so that it rests along the length of the top of the drain body cross-bar 28. Such alignment minimizes the obstruction of the drain passageway. The lip 40 of the drain flange rests 14 on the upper side of the basin wall 36 and the openings 30 and 44 are aligned so that the threaded fastener 20 can be inserted therein and tightened to fasten the drain body 12 and drain flange 14 securely to the basin 36.

Rather than trying to fit one's fingers down into the relatively small drain opening 34, the drain flange 14 is preferably aligned using the stopper guide 18 before the stopper guide 18 is finally assembled. The stopper guide 18 is a suitable re-enforced plastic, such as 25% glass-filled acetyl. The stopper guide 18 has an annular upper end 50 with an axial opening 52 from which depend downwardly two generally planar axial legs 52 and 54 that are strengthened by four perpendicular gussets 56 (two at each leg 52 and 54). The legs 52 and 54 are spaced apart to define a slot 58 there between in communication with the axial opening 52. The legs 52 and 54 have corresponding sets of radial openings 60 and 62, respectively, through which a drain valve stem 64 of a conventional ball-type valve assembly 65 (see FIG. 1) is inserted at a selected point depending on the size of the fixture.

The stopper guide 18 can be used to align the drain flange 14 to the drain body 12 by inserting it into the drain opening 34 so that the legs 52 and 54 fit around the cross-bar 42. The stopper guide 18 can then be rotated until the drain flange cross-bar 44 aligns with the over drain body cross-bar 28. The stopper guide 18 can then be dropped down through the drain flange 14 opening so that it rests on the aligned cross-bars 28 and 42 and the threaded fastener 20 can be inserted through the axial opening 52 in the stopper guide 18 and into the openings 30 and 44 in the respective cross-bars 28 and 42. The fastener 20 can then be tightened to bring the drain body 12 and the drain flange 14 toward each other and against opposite sides the basin 36 to secure the assembly 10 to the basin 36.

Figure 2:
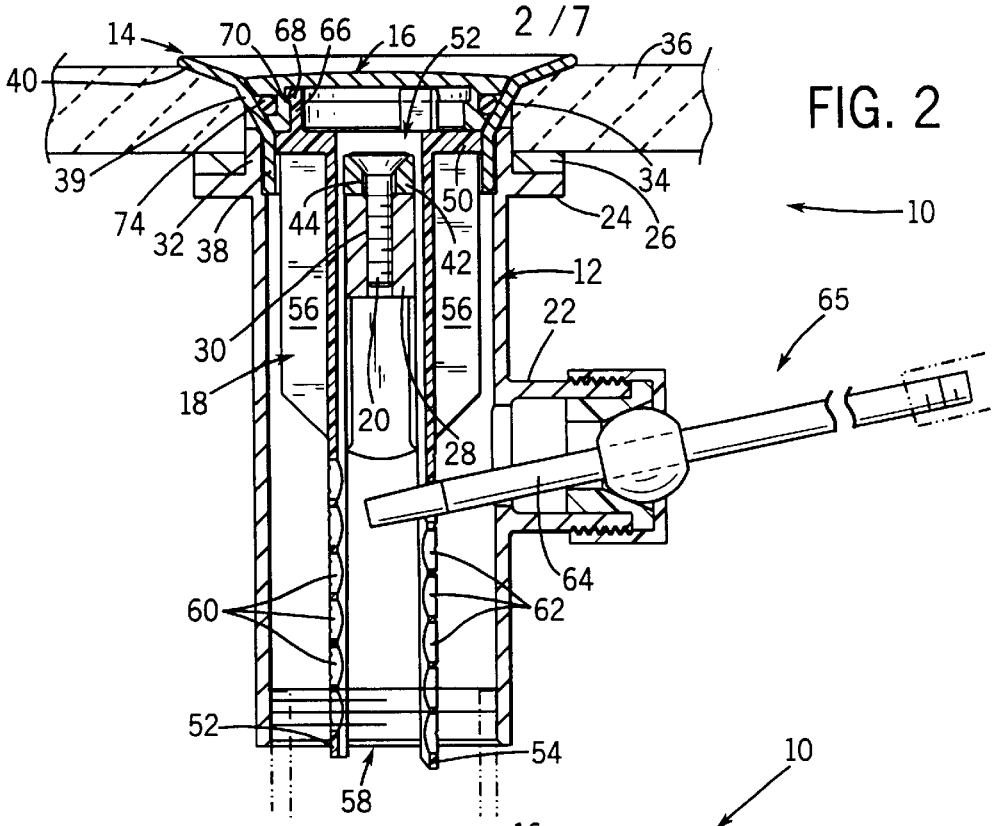
FIG. 2 is a cross-sectional view generally along line 2—2 of FIG. 1 (albeit in assembled form), with the drain stopper closing off the opening in a drain flange.

The stopper guide 18 can then be removed from the assembly for connecting the stopper 16. In particular, three deflectable fingers 66 extend upwardly from the upper end 50 of the stopper guide 18. The fingers 66 have upper latch ends 68 that engage with a circular catch surface 70 at the underside of the drain stopper 16 (see FIG. 2), thereby allowing the stopper 16 to be quickly snapped onto the upper end of the stopper guide 18. It should be noted that other suitable attachment techniques could be employed here, such as a threaded or a pin and slot connection.

The drain stopper is preferably disk-shaped and has a tapered circumference with a circumferential groove 72 for accommodating an o-ring 74. The o-ring 74 and circumferential wall of the stopper 16 are sized to fit tightly against the inner surface of the frusto-conical surface 39 of the drain flange 14 so that the o-ring 74 can make a water-tight seal to restrict flow through the drain flange 14 when in the position shown in FIG. 2.

Figure 3:
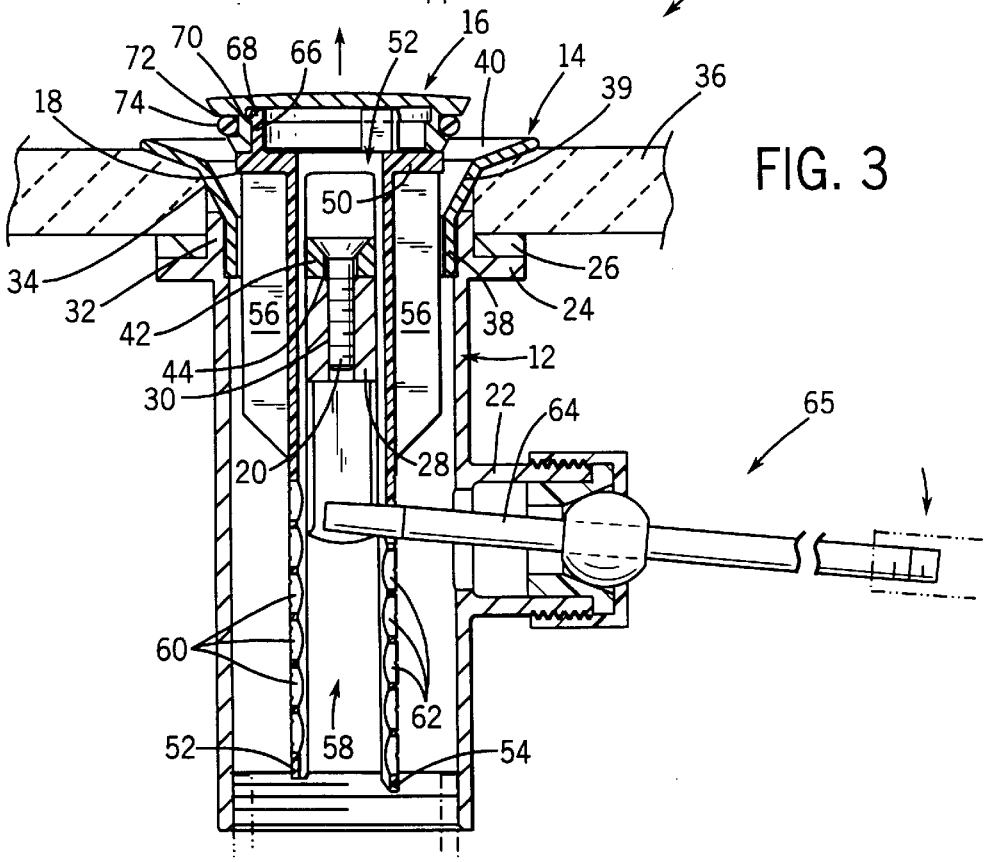
FIG. 3 is a view similar to FIG. 2, albeit with the stopper raised to allow the basin to be drained.

The stopper guide 18 (with the stopper 16 connected thereto) can then be reinserted into the drain opening for connection of the stopper guide 18 to the valve stem 64 of the valve assembly 65 by inserting the valve stem 64 into one or both openings 60 and 62 at the appropriate height of the stopper guide legs 52 and 54. If desired, prior to final assembly, the stopper guide 18 can be removed so that the legs 52 and 54 can be trimmed to remove any excess length. In any event, a suitable drain pull (not shown) linked to the valve assembly 65 can then be used to position the stopper guide 18 (and thus the stopper 16). In particular, the stopper 16 guide 18 can be lowered (as in FIG. 2) to close off the drain and raised (as in FIG. 3) to open the drain.

Figure 4:
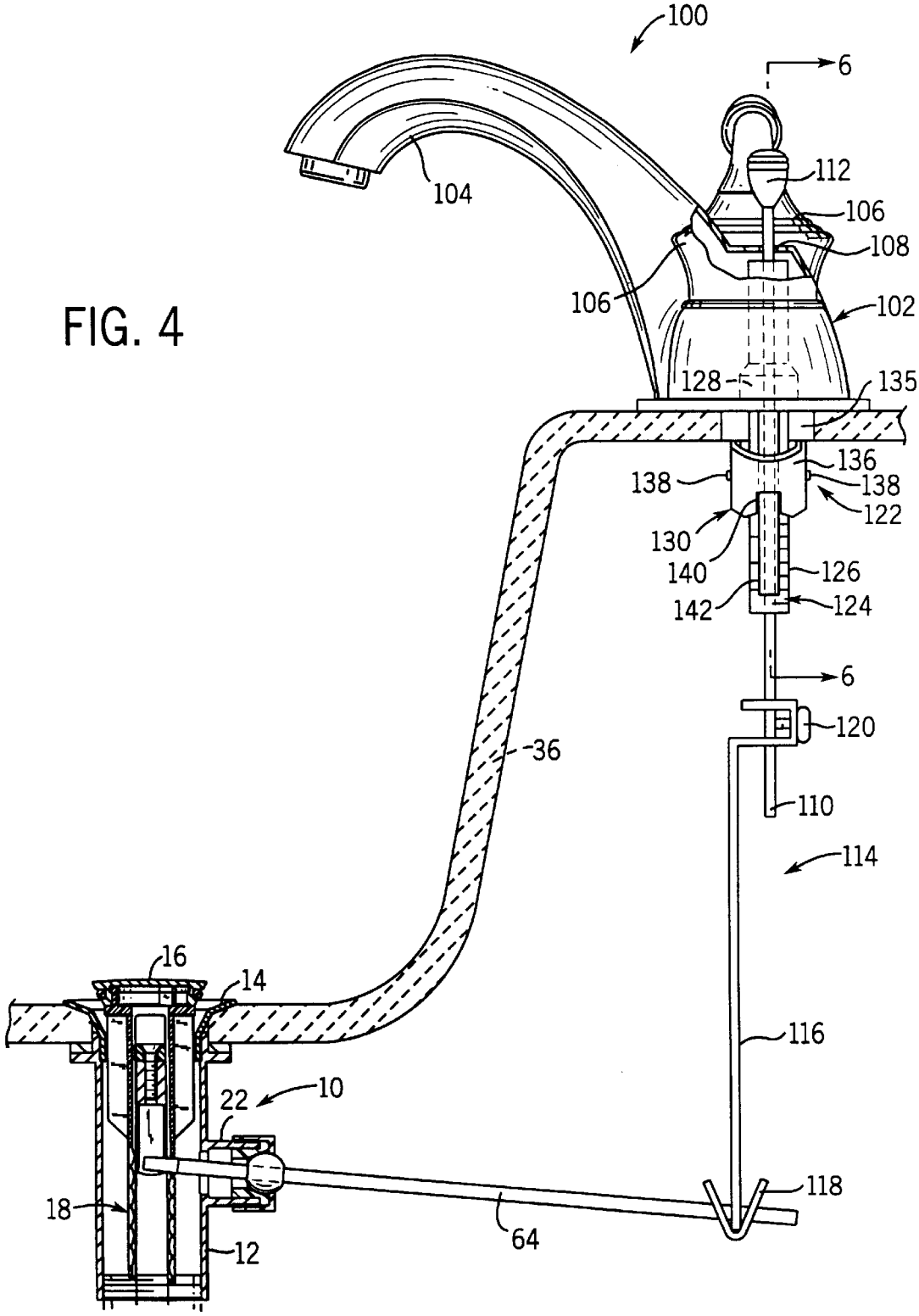
FIG. 4 is a side elevational view, partially in section, of a combined faucet and drain assembly system of the present invention.

Referring now to FIG. 4, the above described drain assembly 10 is particularly suitable to be used with faucet 100 to provide a plumbing system for the sink or bathtub basin 36 that can be mounted primarily from above the basin. In particular, the faucet 100 includes a faucet body 102 with a spout 104 and mounts for rotatable handles 106 operating valves controlling flow of the hot and cold water supplies. The faucet body 102 also includes a single central upper opening 108 between the handles 106 and behind the spout through which extends a lift rod 110 having a pull knob 112 at its upper end and being coupled to the valve stem 64 of the drain assembly 10 via a bracket assembly 114.

As is conventional, the bracket assembly 114 has a connector bar 116 with a plurality of holes spaced apart along a portion of its length through one of which an end of the valve stem 64 is inserted and retained thereto by a bent clip 118. FIG. 4 shows the stem 64 in the lowest hole in the bar 116 in which case the clip 118 can be in the orientation shown, otherwise the clip 118 would be oriented 90 degrees from that shown. The other end of the bar 116 is bent in a backward "C" shape and has openings through which the lift rod 110 is disposed and held at a desired relative position by a set screw 120.

Figure 5:
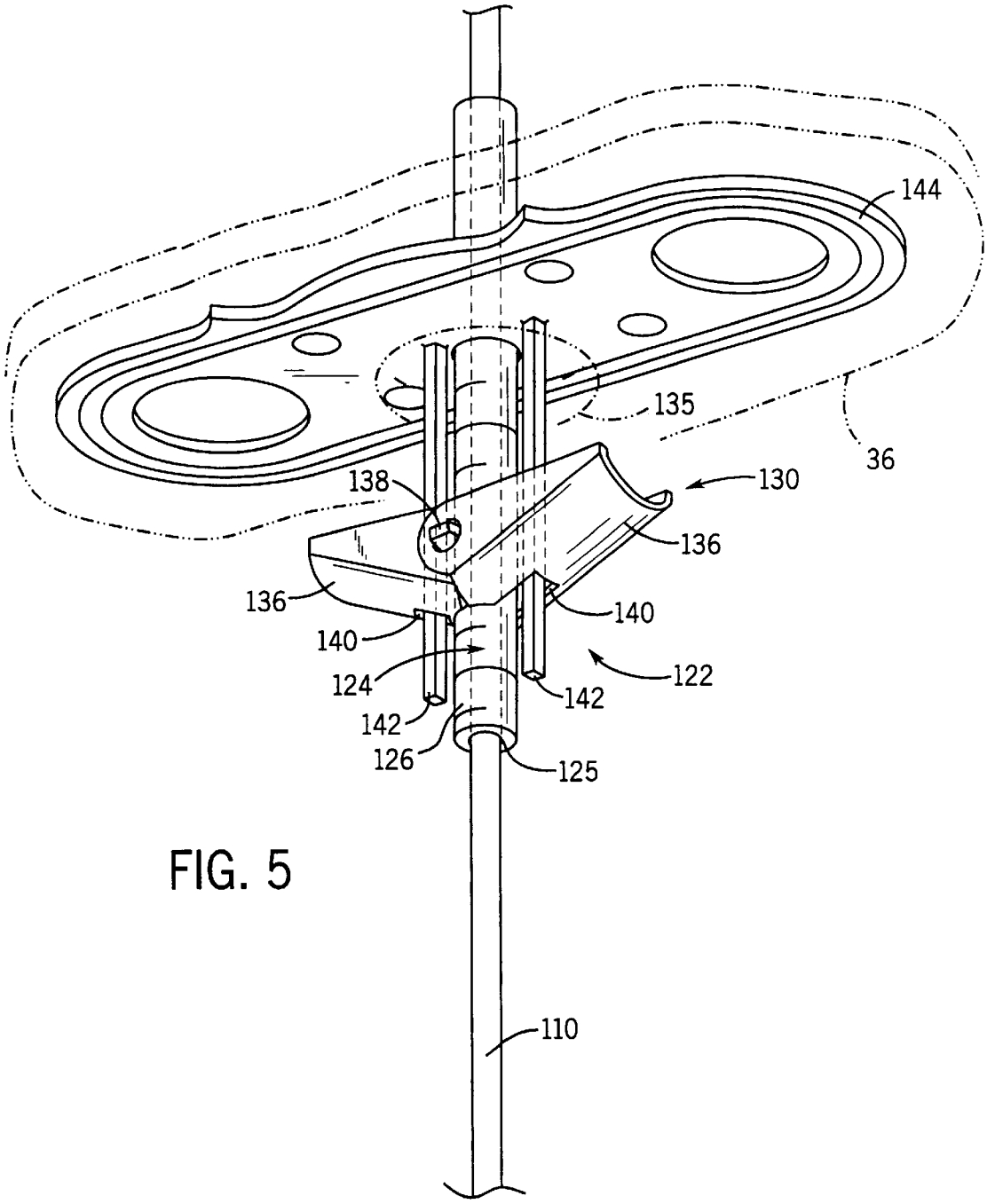
FIG. 5 is a detailed perspective view of a clamping assembly for the faucet of FIG. 4.

Referring now to FIG. 5, the faucet 100 includes a clamping assembly 122 partially disposed within the faucet body 102 and partially extending beneath the basin (or deck supporting the basin). The fastening assembly 122 includes a cylindrical sleeve bolt 124 having an axial opening 125 there through in which the lift rod 110 is disposed for the usual axial movement when it is desired to modify the drain position in the basin. The sleeve bolt 124 also has external threads 126 along a portion thereof below an enlarge intermediate area 128 (engaging a portion of the faucet body or mounting elements thereof—see FIG. 6) to which a pivotal toggle fastener, generally 130, is rotatably mounted.

The toggle fastener 130 includes a spring 132 disposed between a nut 134 and two pivotal arms 136 mounted on posts 138 extending from opposite sides of the nut 134. The arms 136 can be pivoted from an extended position (as shown in FIG. 7) to a collapsed position (shown in phantom in FIG. 6) in which the overall lateral dimension of the toggle fastener 130 is less than the installation opening 135 in the basin (or deck) so that it can be inserted down through the opening 135 from above the basin. The middle of the spring 132 is wrapped around one of the posts 138 with its ends positioned to bias the arms 136 apart (see FIGS. 6 and 9), that is extending generally radially outward from the sleeve bolt 124. The nut 134 (and thus the toggle fastener) threads onto the threaded end of the sleeve bolt 124 by relative rotation of the sleeve bolt 124.

The arms 136 define inner guide openings 140 between the nut 134 and the arms 136 through which a pair of guide posts 142 extend. The guide posts 142 are rod-like structures spaced apart from opposite sides of the sleeve bolt 124. The guide posts 142 are preferably integral with and depend downwardly from a mounting plate 144 having a middle opening for the sleeve bolt 124 and two openings for the faucet water valves.

Figure 6:
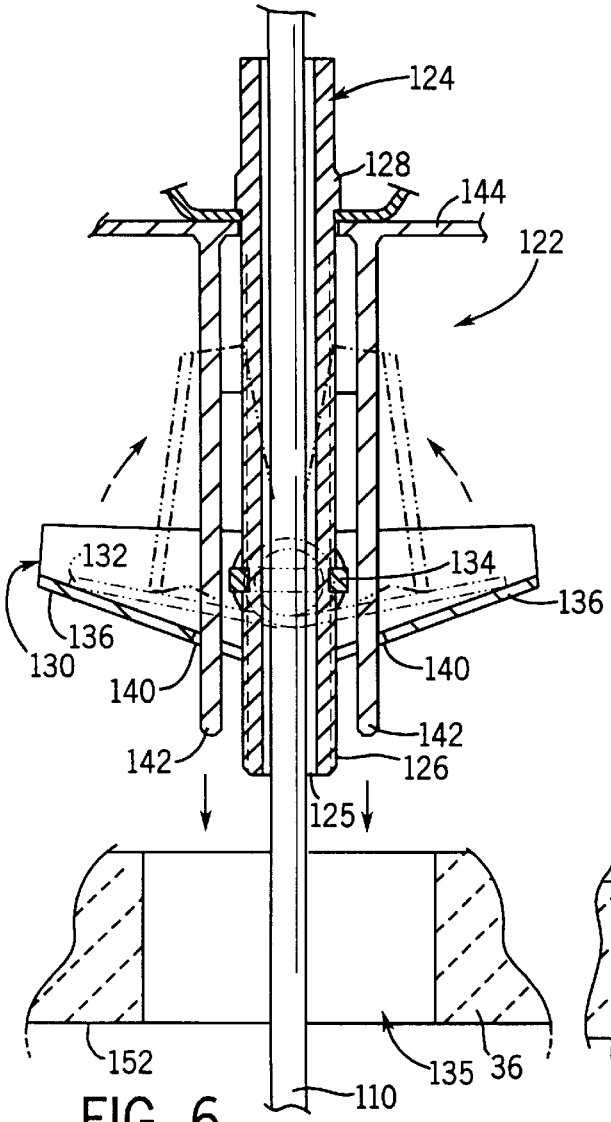
FIG. 6 is a partial cross-sectional view, taken along line 6—6 of FIG. 4, showing the fastening assembly before being mounted to a basin, hidden lines representing arms of a toggle fastener when collapsed.
Figure 7:
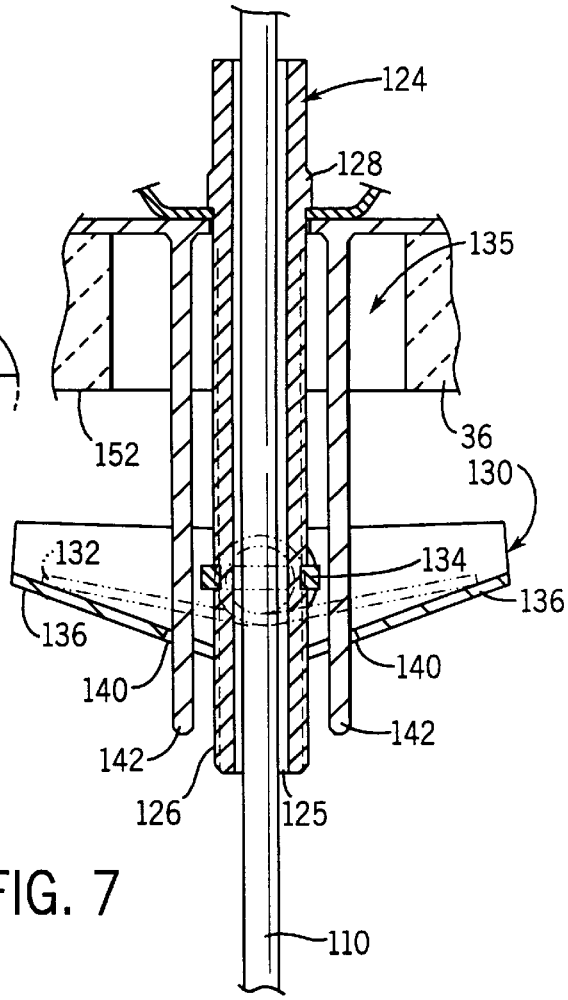
FIG. 7 is a partial cross-sectional view similar to FIG. 6, although with the fastening assembly passed through an installation opening and prior to being tightened.
Figure 11:
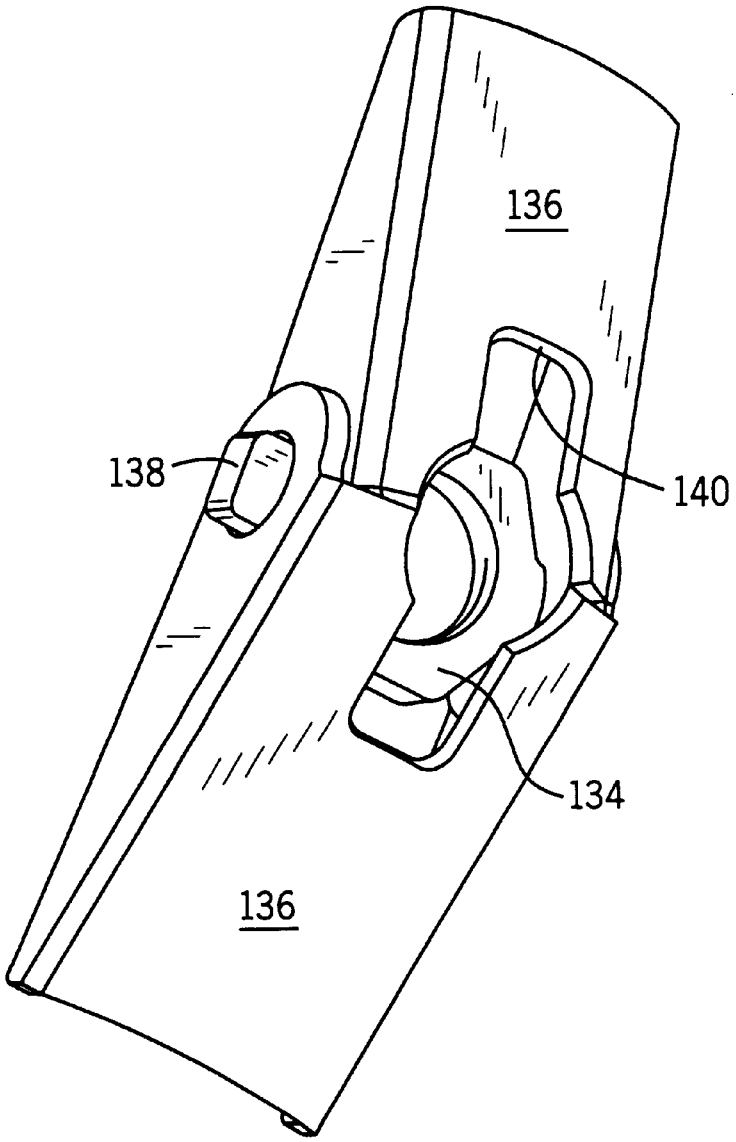
FIG. 11 is a bottom perspective view, partially broken away, of a preferred clamping structure of the present invention.

FIG. 6 shows that the fastening assembly 122 is inserted through the installation opening 135 in the basin (or deck) from above the basin by folding in the arms 136 of the toggle fastener 130 (as shown in phantom). This is done by pushing the assembly through the opening and causing the arms 136 to fold by contact with the basin (or deck) surrounding the opening 135. The assembly looks as shown in FIG. 7 after its lower part is inserted through the opening 135 with the toggle fastener in the extended or unfolded position such that it cannot be pulled back through the opening 135 without manually collapsing the arms 136.

The assembly (and thus the faucet) can then be clamped to the basin (or deck) by rotating the sleeve bolt 124 from above the basin. Rotating the sleeve bolt 124 will initially cause the toggle fastener 130 to rotate until its rotation is limited by interference with the guide posts 142. At that point, the toggle fastener 130 will travel upwardly (or downwardly depending on the direction of rotation) until it contacts an undersurface 152 of the basin (or deck). Further rotation of the sleeve bolt 124 will tighten the assembly to the basin.

As shown in FIG. 10, the upper end of the sleeve bolt 124 preferably has a "universal" tool attachment feature 146. Specifically, this feature 146 is a recess generally centered on the axial opening 125 and has four squared flutes 148 in a cross-pattern and a hexagonal recess 150. This configuration will accept a flat bladed screwdriver (in opposite squared flutes), a Philips screwdriver (in all four flutes) and a hex-headed driver (in the hexagonal recess). Thus, any of these common tools may be used to turn the sleeve bolt 124 with sufficient torque to clamp the faucet 100 in place securely.

The present invention thus provides a system for mounting a combined faucet and drain assembly to a wash basin quickly, easily and primarily from above the basin. The faucet clamp assembly includes a collapsible toggle fastener that can be inserted down through an installation opening in the basin or nearby deck and then springs out so that it can be immediately tightened against an underside of the basin or deck by simply rotating the sleeve bolt. The unique stopper guide can be used during installation to align the drain flange and drain body from above, and hold them in the proper alignment while being secured together and to the basin. The stopper guide can then be removed so that the stopper can be quickly snapped or threaded onto its upper end and then dropped back into the drain opening for attachment to a valve stem of a conventional ball-type control mechanism.

While a specific embodiment has been shown, various modifications falling within the breadth and scope of the invention will be apparent to one skilled in the art. Thus, the following claims should be looked to in order to understand the full scope of the invention.

INDUSTRIAL APPLICABILITY

Disclosed is a combined plumbing fixture and drain assembly system that can be mounted to a sink or bathtub basin in large part from above the basin.

We claim:

1. A faucet mountable through a hole in a mounting wall, the faucet comprising:

a faucet body having an upper opening; and a fastener assembly for connecting the faucet body to the mounting wall, the fastener assembly having:

a sleeve bolt mounted on the faucet body so as to be able to rotate on a longitudinal axis of the bolt, the bolt having a threaded outer section and an axial bore alignable with the upper opening of the faucet body;

a fastener having a nut that is threadable on the threaded outer section of the bolt so as to ride along it in response to rotation of the bolt, the fastener also having a wing structure that is pivotable from a collapsed configuration to an extended configuration, the fastener also having at least one guide opening between the nut and wing structure;

two guides fixed with respect to the faucet body, positioned on opposite sides of the nut; and extending through the at least one guide opening for limiting rotation of the nut around the longitudinal axis of the bolt; and a lift rod positionable through the upper opening of the faucet body and extendable through the axial bore of the bolt.

2. The faucet of claim 1, wherein an upper end of the sleeve bolt has a tool attachment recess.

3. The faucet of claim 2, wherein the recess is suitable to receive all of a flat screwdriver, a Philips screwdriver and a hex-driver, one at a time.

4. The faucet of claim 1, further comprising a spring to bias the wing structure to the extended configuration.

* * * * *